US005917403A

United States Patent [19]

Hashimoto et al.

[11] Patent Number: 5,917,403

[45] Date of Patent: Jun. 29, 1999

[54] RESISTOR COMPOSITION AND RESISTORS USING THE SAME

[75] Inventors: Masato Hashimoto; Akio Fukuoka, both of Fukui, Japan

[73] Assignee: Matsushita Electric Industrial Co., Ltd., Osaka, Japan

[21] Appl. No.: 08/813,546

[22] Filed: Mar. 7, 1997

[30] Foreign Application Priority Data

Mar. 8, 1996 [JP] Japan ..... 8-051256

[51] Int. Cl.[6] ..... H01C 1/012

[52] U.S. Cl. ..... 338/307; 252/514

[58] Field of Search ..... 338/308, 309, 338/332; 29/610.1, 620; 252/512, 514, 521.4

[56] References Cited

U.S. PATENT DOCUMENTS

| | | | |
|---|---|---|---|
| 3,846,345 | 11/1974 | Mason et al. | 252/514 |
| 4,582,659 | 4/1986 | Hilgers et al. | 264/61 |
| 4,657,699 | 4/1987 | Nair et al. | 252/513 |
| 5,096,619 | 3/1992 | Slack | 252/514 |
| 5,339,068 | 8/1994 | Tsunoda et al. | 338/332 |
| 5,366,813 | 11/1994 | Berlin | 428/546 |
| 5,450,055 | 9/1995 | Doi et al. | 338/332 |
| 5,464,564 | 11/1995 | Brown | 252/514 |
| 5,479,147 | 12/1995 | Montgomery | 337/297 |

*Primary Examiner*—Mark H. Paschall
*Assistant Examiner*—Jeffrey Pwu
*Attorney, Agent, or Firm*—McDermott, Will & Emery

[57] ABSTRACT

The present invention minimizes the deviations of desired fuse time in the resistors with fuse function, and this is made of a resistor layer 21 consisting of fine electro-conductive particles, fine glass particles having a melting temperature higher than the forming temperature of the fine electro-conductive particles, a solvent dispersing these particles uniformly, and metal caps 23 connecting resistor film 21 at the ends of substrate 22.

6 Claims, 4 Drawing Sheets

RESISTOR COMPOSITION AND RESISTORS USING THE SAME

TECHNICAL FIELD

This invention relates to a resistor composition employed to manufacture resistors with fuse functions, and to the resistors using the same.

BACKGROUND TECHNOLOGY

In accordance to the enforcement of manufacturer liability law, higher safeties are now essential to various modern electronic devices. In this tendency, demands for the resistor with fuse function as vital electronic components securing the safety is now increasing.

Among the various conventional resistors with fuse function, a cylindrical resistor and a chip type resistor are now explained referring the attached drawings.

FIG. 6 shows a cross-sectional view of conventional cylinder type resistor with fuse function wherein 1 is a metal film deposited on cylinder shaped alumina insulator 2, 3 is a glass layer having a low melting point deposited on metal film 1, 4 are metal caps establishing electrical connections to metal film 1, 5 are lead wires establishing electrical connections to metal caps 4, and 6 is a protection film covering at least metal film 1 and glass layer 3.

FIG. 7 shows a cross-sectional view of conventional chip type resistor with a fuse function wherein 11 is a metal film deposited on alumina insulator 12, 13 is an upper electrode deposited on the side surface of alumina insulator 12 establishing an electrical connection to metal film 11, 14 is a glass layer having a low melting point deposited on metal film 11, 18 is a protection film covering at least metal film 11 and glass layer 14, and 15 is a side electrode deposited on the side of alumina insulator 12 establishing an electrical connection to upper electrode 13. This side electrode 15 is coated with nickel layer 16 and solder layer 17.

With the above-shown resistor constructions, a fused condition of the conventional resistor can be obtained as shown in FIG. 8. In this case, when metal films 1 and 11 are heated by reactive heat and when the temperature rise caused by this heat reaches to the melting point of the glass layers 3 and 14 each having a low melting point, the glass layers 3 and 14 are melted and the molten low melting point glass is diffused into metal films 1 and 11 loosing the path of electrical conduction. However, due to the deviations of heated condition in metal films 1 and 11, heat capacities or coat thickness of glass layers 3 and 14, diffusion velocity of metal films 1 and 11 into glass layers 3 and 14, thicknesses of metal films 1 and 11, deviations of desired fusing times by the over-load application would be inevitable.

The purpose of the present invention is to solve the above-shown problems and to minimize the deviations of desired fusing time by offering a resistor composition realizing the higher safety of circuit design and the resistors of the same.

SUMMARY OF THE INVENTION

The present invention solving such problems offers a resistor composition made of fine electro-conductive particles, glass particles having a melting temperature higher than the forming temperature of said fine electro-conductive particles, and a dispersant dispersing said fine electro-conductive particles and said glass particles uniformly.

Furthermore, the present invention relates to a resistor composition made of fine electro-conductive particles, glass particles having a melting point higher than the forming temperature of said fine electro-conductive particles, a resin dissociable and combustible at a temperature lower than the forming temperature of said electro-conductive particles, and a solvent dissolving said resin, dispersing said fine electro-conductive particles and said glass particles uniformly into said resin.

BRIEF EXPLANATIONS OF THE DRAWINGS

DESCRIPTION OF THE PREFERRED EMBODIMENTS

EMBODIMENT-1

Figure 1:
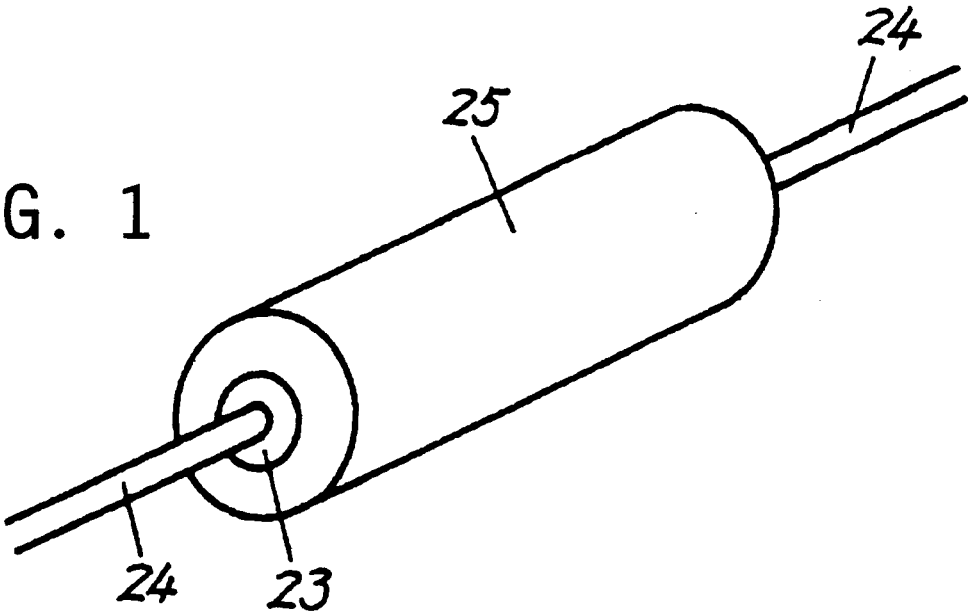
FIG. 1 shows an enlarged perspective view of cylinder type resistor which is Embodiment-1 of the invention.

Embodiment-1 of the invented resistor is now explained by referring the attached drawings by taking for example an a cylinder type resistor having fuse function. FIG. 1 shows an enlarged perspective view of cylinder type resistor which is Embodiment-1 of the invention, and FIG. 2 shows a cross-sectional view of the same.

Figure 2:
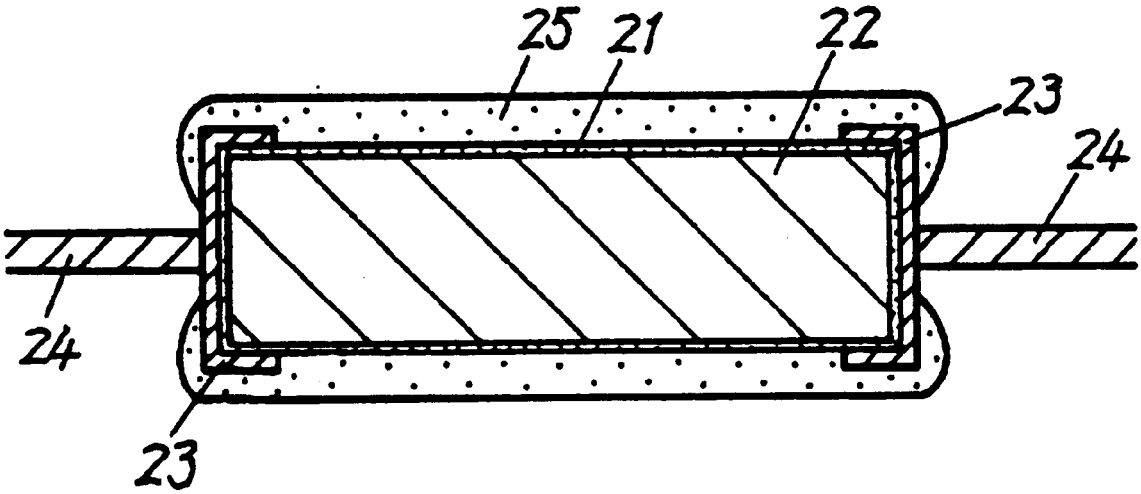
FIG. 2 shows a cross-sectional view of the same.

In FIGS. 1 and 2, 21 is a resistor film deposited on an alumina insulator obtained by uniformly coating a resistor composition consisting of fine electro-conductive particles made of an alloy of Ag and Pd formed within a temperature range between 200–400° C. and fine glass particles having a melting temperature higher than the forming temperature of said fine electro-conductive particles which is a temperature higher than 400° C. and lower than 600° C. into a α-terpineol type solvent and by applying a heat-treatment. Items 23 are metal caps made of a pressed nickel plated iron sheet disposed on the ends of alumina insulator 22 establishing an electric connection with the resistor film 21. Items 24 are lead wires connected to the metal caps 23. Items 25 is a protection layer protecting at least resistor layer 21.

The manufacturing method of the above-explained cylinder type resistor is now explained below.

Accepting cylinder shaped alumina insulators of high heat resistance and insulation, these are immersed into a liquid of resistor composition consisting of: 5 wt % fine particles of alloy consisting of 46 wt % of Ag and 54 wt % of Pd having a forming temperature of higher than 200° C. and lower than 400° C., 0.5 wt % glass particles consisting mainly of boro-silicate lead glass having a melting point higher than the forming temperature of said fine electro-conductive particles which is higher than 400° C. and lower than 600° C., and 94.5 wt % α-terpineol type solvent, then a heat-treatment is applied in a rotating furnace at a temperature of 350° C. for a period of 30 minutes. By this heat treatment, a resistor film made of a uniform mixture of said fine metal particles and glass particles is produced.

Since the fine metal particles in the resistor film are electrically connected in a shape of chains, a stable resistance of said resistor film is realized.

Preferred content of fine electro-conductive particles, fine glass particles and α-terpineol type solvent is 2–10 wt %, 0.2–1 wt % and 89–97.8 wt %, respectively. In addition, preferred range of alloy constitution is 46±5 wt % of Ag and 54±5 wt % of Pd.

Then, metal caps electrically connecting the resistor film are pressed into the ends of alumina insulator using a caulking method. Then, a spiral dicing is performed in order to trim the resistance of resistor film between the metal caps, and this is followed by the welding of lead wires made of solder coated copper wire on said metal caps. Then, by painting a heat resistant inorganic paint on resistor film 2 using a roller method, and by curing this coat at a condition of temperature of 170° C. and 30 minutes, a cylinder type resistor can be obtained.

In this case, the resistor layer can not be formed at a temperature lower than 200° C. and the layer having a proper strength can not be formed at a temperature higher than 400° C.

EMBODIMENT-2

Figure 3:
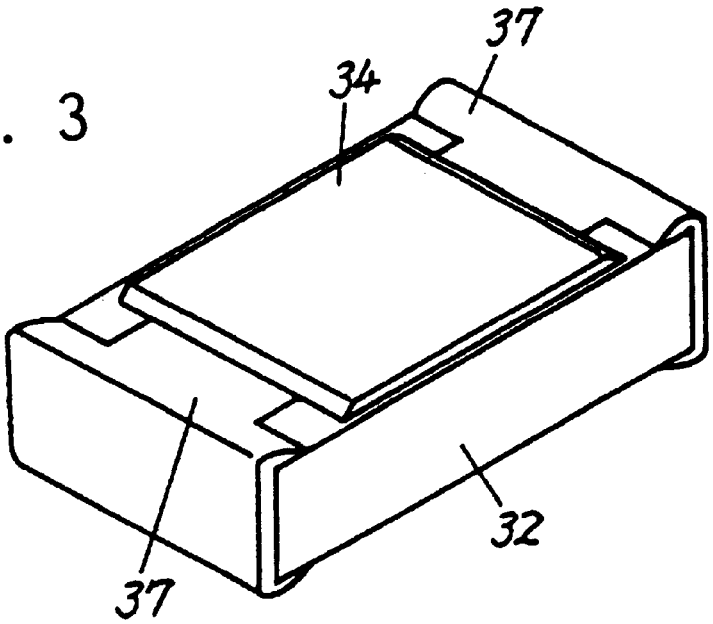
FIG. 3 shows an enlarged perspective view of square chip type resistor which is Embodiment-2 of the invention and FIG. 4 shows a cross-sectional view of the same.
Figure 4:
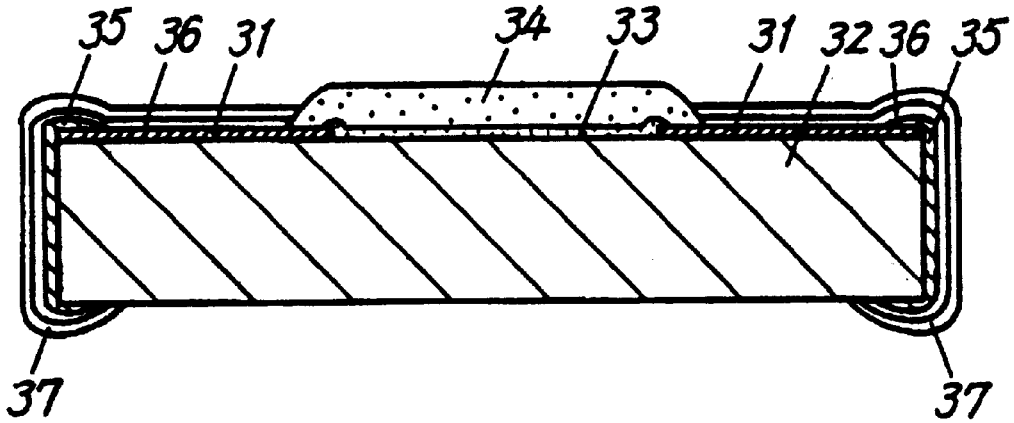

Now, Embodiment-2 of the invented resistor is explained by referring the attached drawings. In here, an example taking for a chip type resistor having fuse function is explained. FIG. 3 shows a perspective view of chip type resistor which is Embodiment-2, and FIG. 4 shows a cross-sectional view of the same. In FIGS. 3 and 4, 31 are a pair of upper electrode layers of silver type thick film disposed on the upper sides of substrate 32 which is made of 96% alumina. 33 is a resistor layer overlaid on substrate 32 obtained by printing a resistor layer consisting of fine electro-conductive particles made of an alloy of Ag and Pd formed within a temperature range which is higher than 200° C. and lower than 400° C., fine glass particles having a melting point higher than the forming temperature of said electro-conductive particles, and a resin dissociable and combustible at a forming temperature of said fine electro-conductive particles, and by applying a heat treatment.

34 is a protection layer protecting at least resistor layer 31, 35 are side electrode layers made of a conductive resin such as Ni-phenol resin provided on the sides of substrate 32 and are connected to the upper electrode layer 31, and 36 and. 37 are a nickel plated layer and a solder coated layer respectively disposed on the exposed side surfaces of electrode layers 35.

The manufacturing processes of the chip type resistor of the above construction is now explained below.

An insulator made of 96% alumina having an excellent heat resistance and insulation characteristics is employed as the substrate. Shallow grooves are performed (by using a die in a case of green sheet) for splitting this into rectangular or individual chips.

Then, a thick-film Ag paste is screen printed onto the upper sides of said substrate and dried, and is sintered in a furnace kept at a temperature of 850° C. held for 5 minutes during the peak period and kept in a temperature profile of IN-OUT 45 minutes in order to form the upper electrode.

Next, a paste-like resistor composition made of: 50 wt % fine alloy particles consisting of 46% Ag and 54% Pd powders having a layer forming temperature in a range above 200° C. and below 400° C.; 15 wt % fine glass particles consisting mainly of boro-silicate lead glass particles having a melting point higher than the forming temperature of said fine electro-conductive particles which is higher than 400° C. and lower than 600° C.; 3 wt % resin component consisting mainly of ethyl cellulose; and 32 wt % α-terpineol type solvent dissolving the resin component is screen printed. This is then sintered in a belt-type continuous furnace kept at a peak temperature of 350° C. for 30 minutes realizing a temperature profile of IN-OUT time 60 minutes forming the resistor layer.

Preferred content of fine electro-conductive particles, fine glass particles, resin component and α-terpineol type solvent is 30–60 wt %, 10–20 wt %, 1–10 wt % and 10–59 wt %, respectively. In addition, preferred range of alloy constitution is 46±5 wt % of Ag and 54±5 wt % of Pd.

In order to adjust the resistance between the upper electrode layers, a part of the resistor layer is trimmed by laser light (L cut, 39 mm/sec, 12 kHz, 5 W) until a desired resistance is obtained.

Then, an epoxy system resin paste is screen printed thereon, and is hardened in a belt-type continuous furnace kept at a peak temperature of 200° C. for 30 minutes using a temperature profile of IN-OUT 50 minutes in order to form protection layer 9.

As a preparation process for forming the side electrode layers, the substrate is divided into rectangular shape substrates exposing the side of electrode layers.

In order to establish electrical connections to the upper electrode layers, a conductive resin paste made mainly of Ni and phenol resin is roller coated on the sides of rectangular substrates and is hardened in a belt-type continuous infra-red hardening furnace kept at a peak temperature of 160° C. for a period of 15 minutes realizing a temperature profile of IN-OUT 40 minutes completing the deposition of side electrode layers.

As a preparation process for electro-plating, the rectangular substrate is divided into individual substrates, and a nickel plated layer and a solder coated layer are formed on the exposed upper electrode layers and side electrode layers by means of an electro-plating, completing the forming of chip type resistors.

Figure 5A:
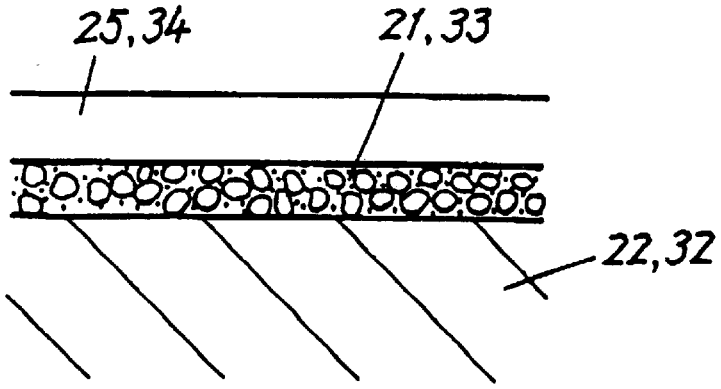
FIG. 5 shows a drawing explaining a fused condition of the invented resistor.
Figure 5B:
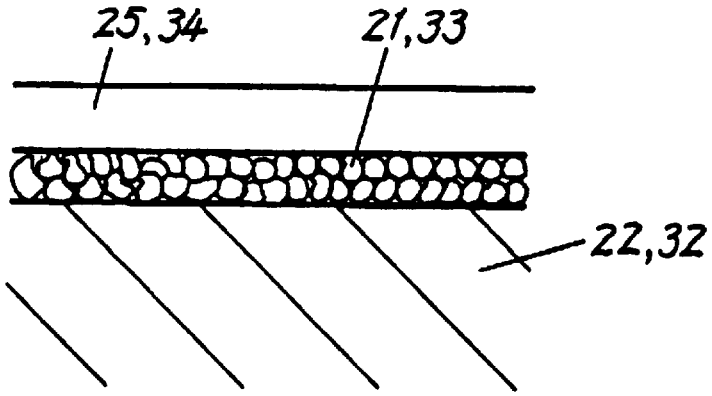
Figure 6:
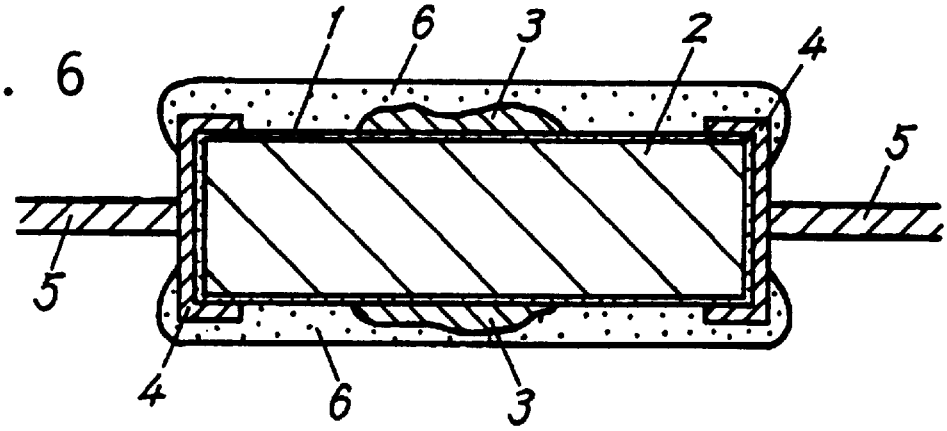
FIG. 6 shows a cross-sectional view of conventional cylinder type resistor.
Figure 7:
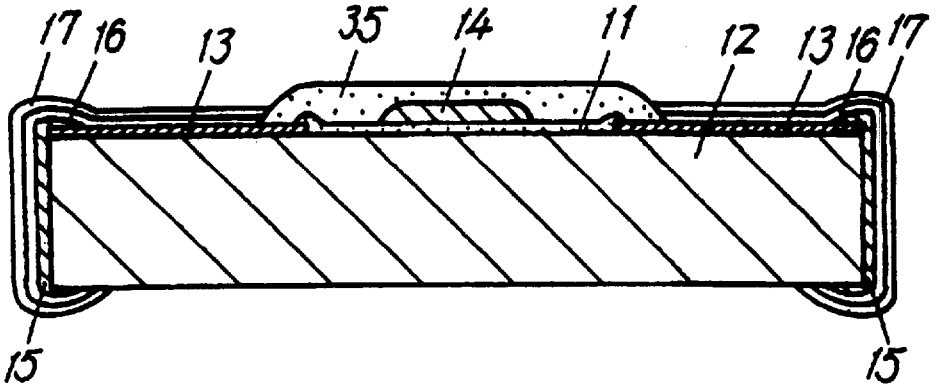
FIG. 7 shows a cross-sectional view of conventional square chip type resistor and FIG. 8 shows a fused condition of conventional resistor.
Figure 8A:
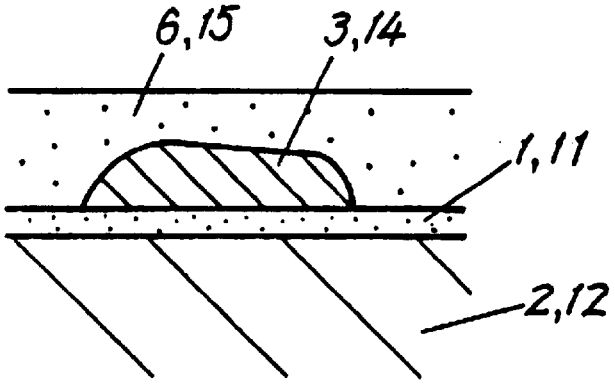
Figure 8B:
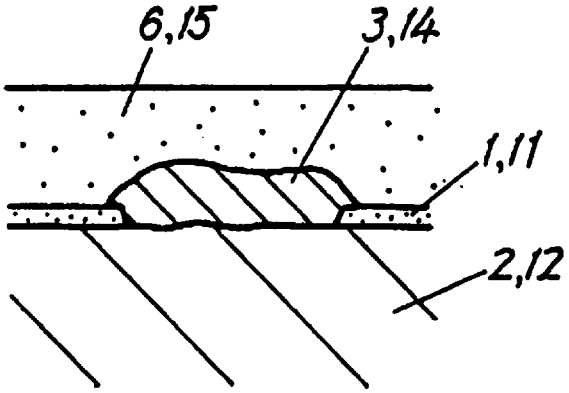

The resistors with fuse function prepared by using Embodiments -1 and -2 and the conventional resistors with fuse functions are soldered on a printed circuit board in order to evaluate the individual fuse functions. The results of these are shown in Table 1 and FIG. 5.

TABLE 1

The Fusing Times When Powers of Ten Times of The Rated Power are Applied

| | Invented Resistors | | Conventional Resistors | |
|---|---|---|---|---|
| | EMBODIMENT I (Cylinder) | EMBODIMENT 2 (Chip) | Chip type | Cylinder type |
| Average Resistance | 1.04Ω | 1.02Ω | 1.04Ω | 0.99Ω |
| Max. Fusing Time | 7 sec. | 5 sec. | 30 sec. | 51 sec. |
| Av. Fusing Time | 5 sec. | 4 sec. | 21 sec. | 35 sec. |
| Min. Fusing time | 3 sec. | 2 sec. | 12 sec. | 9 sec. |

Table 1 shows that the smaller deviations of fuse times can be obtained with the invented resistors comparing over that of conventional resistors. Although the resistor layers are formed at a temperature of 350° C. in these embodiments, these may be well be formed within a claimed temperature range without restriction. Moreover, although the Ag/Pd alloy particles are employed in these cases, any electro-conductive particles dispersible in a solvent may be used.

INDUSTRIAL APPLICATIONS

As shown in the above, the present invention is to offer a resistor composition by which a higher diffusion speed of metal particles into the glass components can be obtained when the temperature of the resistor is reached to the glass melting temperature stabilizing the fusing time and to offer the resistors using the same.

What is claimed is:

1. A layer-forming composition for imparting a fusibility function to a resistor, comprising:

a uniform mixture of fine electro-conductive particles;

glass particles; and a solvent for dispersing the electro-conductive particles and glass particles, wherein the glass particles have a melting point higher than the temperature at which the composition forms a layer.

2. A layer-forming composition for imparting a fusibility function to a resistor, comprising:

a mixture of fine elector-conductive particles;

glass particles, a resin; and a solvent for the resin, wherein the electro-conductive particles and the glass particles are uniformly dispersed in the resin, and wherein the resin is dissociable and combustible at a temperature lower than that at which the composition forms a layer.

3. The layer-forming composition according to claim 1, wherein said layer forming temperature of said fine electro-conductive particles is in a range of 200–400° C. and the melting point of said glass particles is in a range of 400–600° C.

4. The layer-forming composition according to claim 2, wherein said layer forming temperature of said fine electro-conductive particles is in a range of 200–400° C., the melting point of said glass particles is in a range of 400–600° C., and the dissociation and burning temperature of said resin is less than 300° C.

5. A resistor comprising:

an insulator having two ends;

a resistor film on said insulator; and an electrode disposed on an end of said insulator and another electrode disposed on another end of said insulator establishing an electrical connection with said resistor film, wherein said resistor film is prepared by the following process:

preparing a resistor composition comprising:

fine electro-conductive particles having a layer forming temperature:

glass particles having a melting point higher than the layer forming temperature of said fine electro-conductive particles and said glass particles; and a solvent dispersing said fine electro-conductive particles and said glass particles into a uniform mixture:

coating said resistor composition on a part or entire surface of said insulator; and heating said resistor composition on said insulator, wherein said resistor film is fused when the resistor reaches a temperature that exceeds the melting point of said glass particles.

6. A resistor comprising:

a substrate having two ends;

a resistor film formed on at least one surface of said substrate; and an electrode disposed on an end of said substrate and another electrode disposed on another end of said substrate establishing an electrical connection with said resistor film, wherein said resistor film is prepared by the following process:

preparing a resistor composition comprising:

fine electro-conductive particles having a layer forming temperature;

glass particles having a melting point higher than the layer forming temperature off said fine electro-conductive particles; and a resin dissociable and combustible at a temperature lower than the layer forming temperature of said fine electro-conductive particles;

printing said resistor composition on said substrate; and heating said resistor composition on said substrate, wherein said resistor film is fused when the resistor reaches a temperature that exceeds the melting point of said glass particles.

* * * * *